US006402183B1

(12) United States Patent
Marmonier et al.

(10) Patent No.: US 6,402,183 B1
(45) Date of Patent: Jun. 11, 2002

(54) SKI BOOT

(75) Inventors: Gilles Marmonier, St Etienne de Crossey; Guillaume De France, Tullins, both of (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/494,718

(22) Filed: Jan. 31, 2000

(30) Foreign Application Priority Data

Nov. 26, 1998 (FR) ..... 9815088
Feb. 2, 1999 (FR) ..... 9901326

(51) Int. Cl.[7] ..... A63C 9/00
(52) U.S. Cl. ..... 280/613; 280/607; 280/611; 36/117.1
(58) Field of Search ..... 280/607, 611, 280/613; 36/115, 117.1, 117.3, 117.4

(56) References Cited

U.S. PATENT DOCUMENTS 3,677,567 A 7/1972 Salomon
3,852,896 A * 12/1974 Pyzel et al. ..... 280/617
3,957,280 A * 5/1976 Turnheim et al. ..... 280/613
5,595,396 A 1/1997 Bourdeau
5,799,957 A 9/1998 Ueda Yutaka et al.
5,887,886 A * 3/1999 Bourdeau ..... 280/613
5,906,388 A * 5/1999 Neiley ..... 280/613
5,918,386 A * 7/1999 Marmonier ..... 36/117.3
6,105,996 A * 8/2000 De France ..... 280/624
6,126,179 A * 10/2000 Dodge ..... 280/14.2

FOREIGN PATENT DOCUMENTS

CH 674 623 6/1990
FR 1587912 4/1970
FR 2 769 799 4/1999
WO WO 9726959 A 7/1997
WO WO 9830292 A 7/1998

OTHER PUBLICATIONS

French Preliminary Search Report in SN FR 9901326.

* cited by examiner

*Primary Examiner*—J. J. Swann
*Assistant Examiner*—James S. McClellan
(74) *Attorney, Agent, or Firm*—John Moetteli; Bugnion S.A.

(57) ABSTRACT

A ski boot consisting of a flexible upper (1) in the form of a shoe fixed to a rigid intermediate sole (4) on which smooth bearing surfaces **(6*a*, 7*a*) are formed, the intermediate sole being covered by a walking sole (11)** leaving free the bearing surfaces which are preferably set back from the walking surface. These bearing surfaces are intended to bear on and slide over the corresponding surfaces of a safety binding.

7 Claims, 1 Drawing Sheet

Fig.1
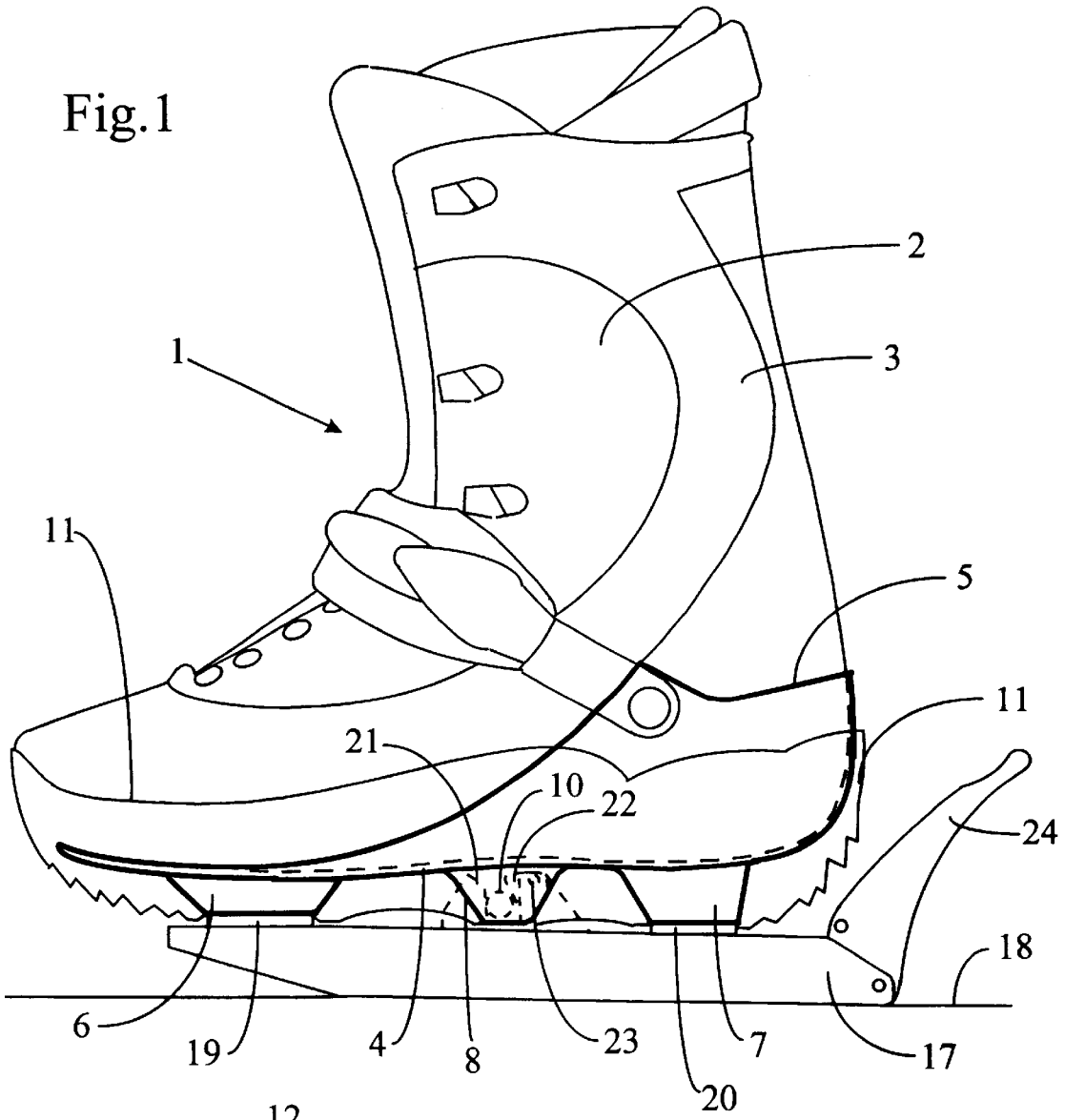
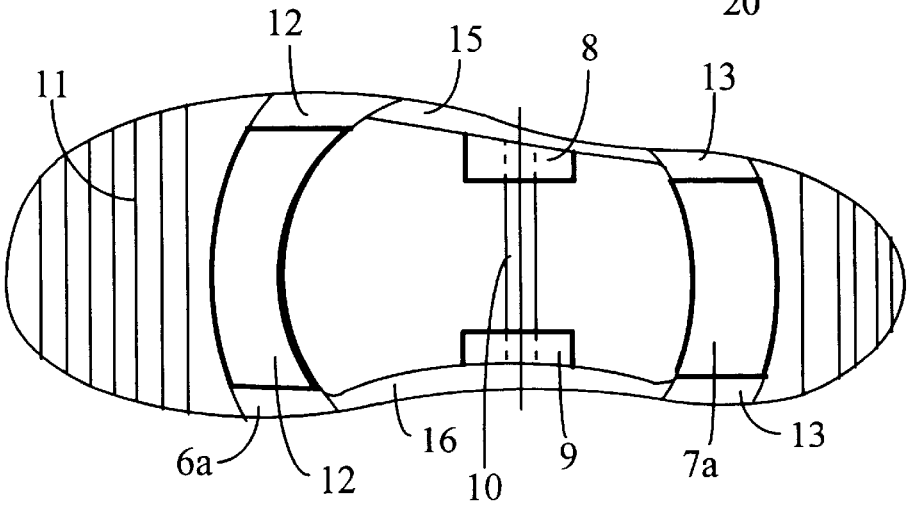
Fig.2

SKI BOOT

BACKGROUND OF THE INVENTION

The invention relates to a ski boot whose sole has at least two smooth bearing surfaces intended to bear on smooth surfaces of a safety binding and extending transversely with respect to the sole.

U.S. Pat. No. 3,677,567, the content of which is incorporated by reference, discloses a ski boot whose sole has two straight transverse grooves whose smooth bottom is intended to facilitate the lateral sliding of the boot on two bars fixed transversely on the ski, so as to facilitate the lateral release of the binding in the event of falling. The bottom of the grooves hence constitutes a smooth bearing surface set back from the surface by which the the sole bears on the ground, so that these smooth bearing surfaces do not enter into contact with the ground during walking and consequently do not suffer damage. According to an alternative embodiment, the bottom of the grooves is covered by a sheet having a low coefficient of friction.

Further, Patent CH 674 623, the content of which is incorporated by reference, discloses a central binding device for a ski boot, having two rollers mounted on horizontal pins in the front plate of the central binding, the boot being provided with a transverse groove whose bottom constitutes a bearing and rolling surface for the rollers.

SUMMARY OF THE INVENTION

The object of the present invention is to provide a boot which has the same advantages as regards lateral or rotational movement, but also provides a good level of comfort, and a walking sole which is more flexible and has better grip without losing its functionality as an interface between the leg and the ski, a further aim being for this boot to be manufactured more rationally.

The ski boot according to the invention is one wherein the bearing surfaces are formed on a rigid intermediate sole carrying at least one fastening member for connecting it to a ski binding and covered by a walking sole leaving the bearing surfaces free, which boot also comprises a flexible upper in the form of a shoe fixed to the rigid intermediate sole.

The flexible upper in the form of a shoe can be completed independently of the rigid intermediate sole and the walking sole. It is then fixed to the intermediate sole, then the walking sole is molded over or adhesively bonded to the intermediate sole, leaving the bearing surfaces free. The walking sole preferably surrounds the bottom of the upper so as to strengthen and seal the boot over a certain height.

The bearing surfaces are advantageously set back from the surface by which the sole bears on the ground, so that they are less likely to come into contact with the ground and, if they do, with less pressure so as not to become damaged, in particular scratched, which would reduce their capacity for sliding.

BRIEF DESCRIPTION OF THE DRAWINGS

The appended drawing represents an embodiment of the boot according to the invention by way of example.

FIG. 1 is a side view of the ski boot in which the rigid intermediate sole has been represented showing through by heavy lines.

FIG. 2 is a view from below.

DETAILED DESCRIPTION OF THE PREFERRED EMBODIMENTS

The boot represented comprises an upper 1 in the form of a flexible shoe having, in the known way, areas 2 of woven material and areas, such as the area 3, of flexible plastic. This shoe is fixed, for example by adhesive binding, on a rigid intermediate sole 4 raised at the rear and on the sides, over the majority of the length of the sole, so as to form a kind of cradle 5 in which the upper 1 is engaged.

On its lower face, the intermediate sole 4 is provided with two transverse ribs 6 and 7, located respectively under the sole of the foot, in the metatarsophalangeal area, and under the heel. These ribs 6 and 7 are relatively wide and have a trapezoidal profile whose small bases define two plane bearing surfaces 6*a* and 7*a*. In plan view, their surface is plane and smooth and they extended least approximately in circle arcs around a point corresponding to the axis of rotation of the boot on the binding in the event of a twisting force. As can be seen in FIG. 2, the ribs 6 and 7 do not extend over the fall width of the intermediate sole. In its central region, the intermediate sole 4 also has two blocks 8 and 9, also of trapezoidal profile and forming two additional bearing surfaces. A metal bar 10 is fixed between these blocks 8 and 9, transversely with respect to the sole. The rigid intermediate sole is covered, by overmolding, with a walking sole 11 which also covers the bottom of a part of the circumference of the upper 1, but while leaving free the bearing surfaces 6*a*, 7*a* of the ribs 6 and 7, as represented in FIG. 2, as well as the bases of the blocks 8 and 9 and the bar 10. As can be seen in FIG. 1, the bearing surfaces 6*a*, 7*a* are flush with the surface of the walking sole 11. These bearing surfaces could, however, be substantially set back from the surface of the walking sole 11. The same is true as regards the bearing surfaces of the blocks 8 and 9. The walking sole 11 is, for example, made of the thermoplastic rubber known by the commercial abbreviation TPR. At each of the ends of the rib 6, the walking sole 11 has a recess 12, continuing the bearing surface 6*a* of the rib in the form of a groove whose depth is substantially less than the height of the rib 6. Similarly, the walking sole 11 has an indentation 13 at each of the ends of the rib 7. On either side of the bearing surface of the blocks 8 and 9, the walking sole 11 has an oblique surface similar to a chamfer.

FIG. 1 represents the boot fixed on a safety binding 17, itself fixed to a ski 18. This binding comprises two smooth bearing surfaces 19 and 20 on which the ribs 6 and 7 come to bear. The bar 10 of the boot engages and wedges between a pair of bearing pieces 21 and a cam 22 articulated about a horizontal pin 23, it being possible for these bearing pieces 22 and the support of the cam 22 to be moved apart from one another against the action of springs. The binding is also equipped at the rear with a lever 24 for releasing the bar 10 and, consequently, removing the boot from the binding. The center of the circle arcs defined above corresponds to the center of the bar 10, that is to say to the center of the fastening member by which the boot turns on the binding in the event of a twisting force.

When the safety binding experiences a twisting force, the bearing surfaces 6*a* and 7*a* facilitate release by sliding over the binding. In the event of falling forward or backward, the bearing surfaces 6*a* and 7*a* fulfill the function of a bearing point accompanied by a lever effect promoting the release of the binding.

The bearing surfaces are advantageously set back from the surface by which the sole bears on the ground, so that they are less likely to come into contact with the ground and, if they do, with less pressure so as not to become damaged, in particular scratched, which would reduce their capacity for sliding.

Of course, the drawing only represents one example of an embodiment. The rigid intermediate sole could be modified to fit any other type of ski binding. In particular, the rigid intermediate sole could have a front ridge and a rear ridge, extending beyond the walking sole 11, for using the boot with a conventional ski binding having a toe piece and a heel piece. In this case, the blocks 8 and 9 and the bar 10 would, of course, be omitted. The ribs 6 and 7 could be straight instead of being as an arc of a circle. The intermediate sole could be fitted with any fastening means or member, for example with means as described in U.S. patent application Ser. No. 09/173,534, the content of which is incorporated by reference.

The bearing surfaces 6*a* and 7*a* could also consist of the surface of a metal plate intended to interact with a safety binding.

The ribs 6 and 7 defining the bearing surfaces may either be made integrally, by molding, with the rigid intermediate sole, or as a separate attachment. In the latter case, they may be made of any material, in particular metal. The bearing surfaces could be discontinuous, for example formed by studs.

In order to make it easier to walk, the intermediate sole could extend only from the heel to the metatarsophalangeal region.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A ski boot whose sole has at least two smooth bearing surfaces (6*a*, 7*a*) intended to bear on projecting surfaces (19, 20) of a safety binding releasing in the event of an excessive twisting force, the projecting surfaces extending transversely with respect to the sole, wherein the bearing surfaces (6*a*, 7*a*) are formed on a rigid intermediate sole (4) carrying at least one fastening member (10) for connecting it to ski binding and covered by a walking sole (11) leaving the bearing surfaces free, which boot also comprises a flexible upper (1) in the form of a shoe fixed to the rigid intermediate sole, wherein the smooth bearing surfaces (6*a*, 7*a*) extend over circular arcs at least approximately concentric with the center of the fastening member (10) and along which the safety binding torsionally released the boot in the event of an excessive twisting force.

2. The ski boot as claimed in claim 1, wherein the rigid intermediate sole (4) is in the form of a cradle (5) starting from the heel and extending over at least part of its length.

3. The ski boot as claimed in claim 1, wherein the intermediate sole extends only from the heel to the metatarsophalangeal region.

4. The ski boot as claimed in claim 1, wherein the bearing surfaces (6*a*, 7*a*) are formed by ribs (6,7).

5. The ski boot as claimed in claim 1, wherein the bearing surfaces (6*a*, 7*a*) consist of at least one separate piece attached to the rigid intermediate sole.

6. The ski boot as claimed in claim 5, wherein the bearing surfaces (6*a*, 7*a*) consist of the surface of a metal plate intended to interact with the safety binding for connecting the boot to the ski.

7. The ski boot as claimed in claim 1, wherein the smooth bearing surfaces (6*a*, 7*a*) are set back from the surface by which the sole bears on the ground.

* * * * *